US007237701B2

(12) United States Patent
Ritzmann et al.

(10) Patent No.: US 7,237,701 B2
(45) Date of Patent: Jul. 3, 2007

(54) HANGER BEAM CONSTRUCTION

(75) Inventors: Ellen Stein Ritzmann, New City, NY (US); Joseph Pluchino, Mount Olive, NJ (US)

(73) Assignee: Randy Hangers, LLC., East Rutherford, NJ (US)

( * ) Notice: Subject to any disclaimer, the term of this patent is extended or adjusted under 35 U.S.C. 154(b) by 97 days.

(21) Appl. No.: 11/000,865

(22) Filed: Dec. 1, 2004

(65) Prior Publication Data

US 2006/0113335 A1 Jun. 1, 2006

Related U.S. Application Data

(60) Provisional application No. 60/535,660, filed on Jan. 9, 2004.

(51) Int. Cl.
*A41D 27/22* (2006.01)

(52) U.S. Cl. ..... 223/85

(58) Field of Classification Search ..... 223/85–98
See application file for complete search history.

(56) References Cited

U.S. PATENT DOCUMENTS

| | | | | |
|---|---|---|---|---|
| 6,435,387 | B1 * | 8/2002 | Gouldson et al. | 223/96 |
| 6,588,634 | B2 * | 7/2003 | Gouldson et al. | 223/96 |
| 2001/0015362 | A1 * | 8/2001 | Zuckerman | 223/96 |
| 2003/0183665 | A1 * | 10/2003 | Olk et al. | 223/85 |
| 2004/0256425 | A1 * | 12/2004 | Barre et al. | 223/85 |

* cited by examiner

*Primary Examiner*—Shaun R. Hurley
(74) *Attorney, Agent, or Firm*—Katten Muchin Rosenman LLP

(57) ABSTRACT

A garment hanger comprising pinch grip clips has a unique molded beam design for added strength and stability. The cross-section of the hanger beam comprises an "S"-shaped design extending along the beam between the pinch grip clips. The "S"-shaped construction reduces warping in the beam body that may be caused by heavy clothing material or frequent use. Alternatively, a "Z"-shaped design may also be used.

16 Claims, 5 Drawing Sheets

HANGER BEAM CONSTRUCTION

CROSS-REFERENCE TO RELATED APPLICATION

This is application claims priority from U.S. Provisional Application 60/535,660 filed on Jan. 9, 2004, which is herein incorporated by reference.

BACKGROUND OF THE INVENTION

1. Field of Invention

The present invention relates generally to the field of beam construction for a hanger. More specifically, the present invention is related to a beam construction having increased strength and stability with reduced warping and material requirements.

2. Discussion of Prior Art

Pinch grip garment hangers are typically used to hold clothing and garments such as pants or skirts or undergarments. Therein, a garment hanger requires strength and stability to hold clothing of all weights and sizes. Garment hangers may be molded in one complete design or comprised of several parts, for example the hook or clips, attached to a molded body.

The strength and stability of the hanger comes from its beam design. Unfortunately, the hanger body or beam portion is subject to a substantial amount of wear and tear due to the heaviness or weight of the clothing material and frequent use. Particularly, a substantial amount of warping in molded hangers occurs in the beam. The designs currently used in the art do not provide a strong structure and therefore do not sufficiently address this problem.

Therefore, what is desired is a garment hanger having a beam construction that increases the strength of the beam to deter warping as well as to reduce the amount of material needed for construction. For example, a curved or inclined construction connecting a top and bottom part of a hanger beam is not described in the prior art and is desired. More specifically, what desired is a clothes hanger beam having a structural cross-section in the form of an "S" or "Z" shape.

It is known to use hanger beams of different designs.

U.S. Pat. No. 5,071,045 appears to disclose a standard "channel-back" design with a generally inverted U-shaped cross section. However, a curved, inclined, "S"- or "Z"-shape cross-section is not disclosed.

U.S. Pat. Nos. 5,785,216; 6,085,950; 6,435,387; and 6,588,634 and U.S. Patent Application Publication 2003/0155387 appear to describe "M"-shaped cross-sections. The use of a curved, inclined, or an "S"- or "Z"-shaped cross section, however, is not disclosed.

U.S. Pat. No. 5,992,714 appears to show a double "I" cross-section. U.S. Pat. Des. 187,092 appears to disclose a similar double "I" cross-section that is separated by a gap. Neither reference, however, discloses a curved, inclined, "S"- or "Z"-shaped cross-section.

SUMMARY OF THE INVENTION

A garment hanger comprises a hook member and pinch grips as well as a body member comprising a molded beam with an "S"- or "Z"-shaped cross section. The "S"- and "Z"-shaped cross sections provide greater strength and stability to the beam and body member to reduce warping and reduce the use of material. The cross sections generally comprise a curved shape with a top, bottom, and middle section. The middle section may comprise at least two bends or an incline connecting the top and bottom sections. The garment hanger may have a separately attached hook or be of one-piece, molded construction. The beam design may also be used on an insert that is attached to the hook of another hanger.

DESCRIPTION OF THE PREFERRED EMBODIMENTS

Figure 1A:
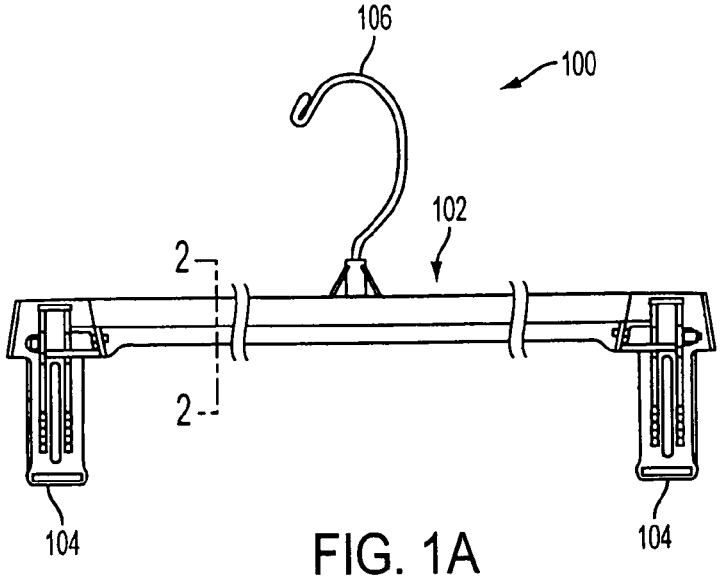
FIGS. 1*a*, 1*b* and 1*c* illustrate a profile view with left and right end views of a pinch grip garment hanger incorporating the preferred beam construction.

While this invention is illustrated and described in a preferred embodiment, the device may be produced in many different configurations, forms and materials. There is depicted in the drawings, and will herein be described in detail, a preferred embodiment of the invention, with the understanding that the present disclosure is to be considered as an exemplification of the principles of the invention and the associated functional specifications for its construction and is not intended to limit the invention to the embodiment illustrated.

FIGS. 1–6 illustrate "S"- and "Z"-shaped designs that may be in a forward-facing or reversed direction without changing or having an affect on the scope of the present invention. Those skilled in the art will envision many other possible variations within the scope of the present invention.

Figure 1B:
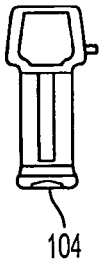
Figure 1C:
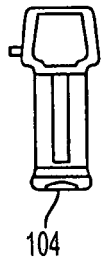

FIGS. 1*a*, 1*b* and 1*c* illustrate one embodiment of a hanger of the present invention. Therein, FIG. 1*a* illustrates a profile view; FIGS. 1*b* and 1*c* left and right end views, respectively, illustrate a pinch grip garment hanger 100 incorporating the preferred beam construction shown in cross-section in FIG. 2. Hanger 100 comprises hanger beam 102, pinch grips or clips 104, and hook 106. The hanger is representative of styles 7112 and 7114 of the assignee, Randy Hangers, LLC, of the present invention. Typically, these hangers include a molded body and metal hook. Hanger 100, for example, may have a profile of 12 to 14 inches.

Figure 2:
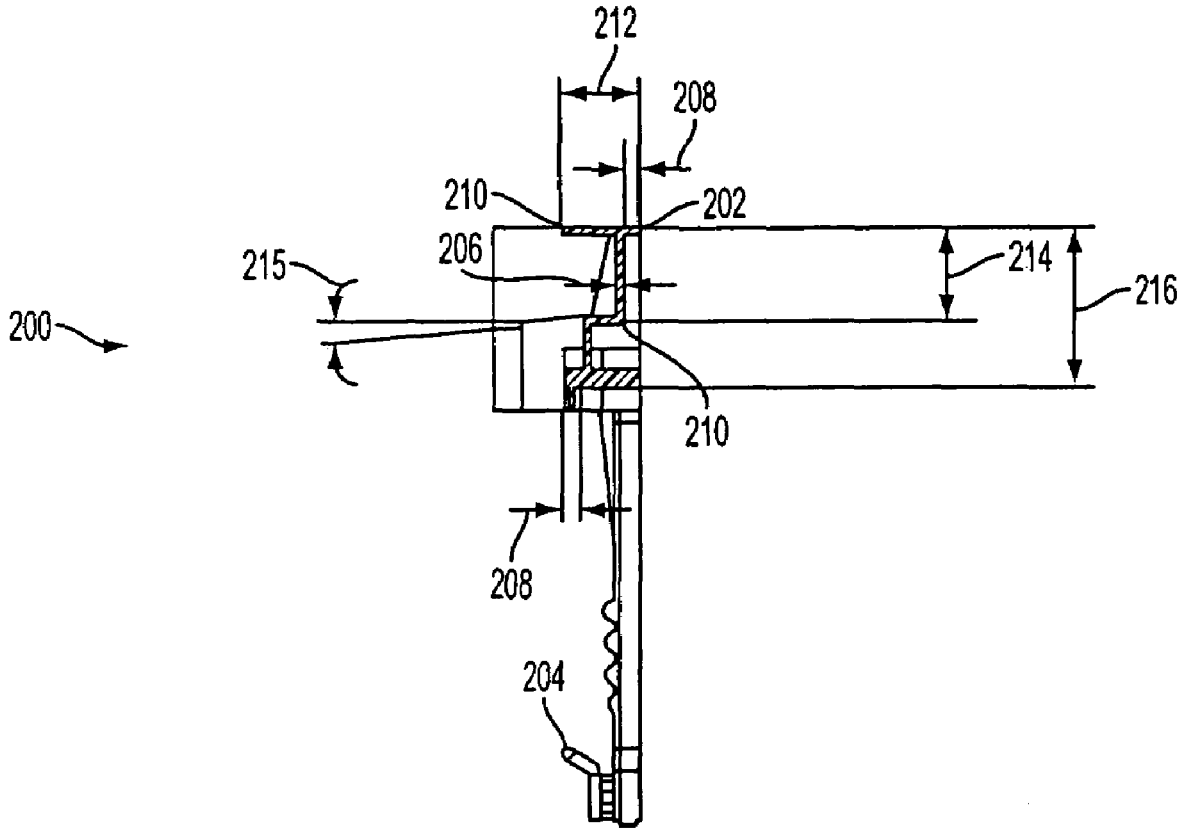
FIG. 2 illustrates the cross-section A—A of FIG. 1 showing the preferred "S"-shaped cross beam.

FIG. 2 is an end view taken through the cross section line A—A of FIG. 1*a*. Shown is cross-section 200 of hanger beam 102 with "S"-shaped cross section 202 and a side profile of end clip 204. The "S"-shaped cross section is provided with preferred dimensions for thickness 206, extensions 208, edge radius 210, overall width 212, height of the bend or curve 214, and overall height 216. Preferably, shaped cross section 202 has thickness 206 between 0.035 and 0.045 inches. As shown in FIG. 2, the top and bottom of the shaped cross section have extensions 208 preferably 0.080 inches from the "S"-curve. The edges preferably have radius 210 of 0.030. The bend or curve in the "S" is preferably formed at a height 214 of 0.490 inches with slope 215 of a 2 degree. Finally, the overall width 212 and overall height 216 may be any dimension but are preferably 0.375 inches and 0.875 inches, respectively.

Advantageously, "S"-shaped cross section 202 imparts strength and stability to the longitudinal axis of the hanger, reduces warping relative to known "I"-beam cross-sectional designs, and enables a reduction in hanger material without sacrificing overall hanger strength.

Although a pinch-grip garment hanger is illustrated and described in the preferred embodiment, it should be noted that the cross-sectional design for the hanger beam should not be limited to pinch grip hangers. For example, the design may be applied to garment hangers having traditional, extended arms, such as those used to hold shirts and jackets, or other hanger designs comprising cross sections designed to increase strength and reduce warping or wear and tear.

Figure 3A:
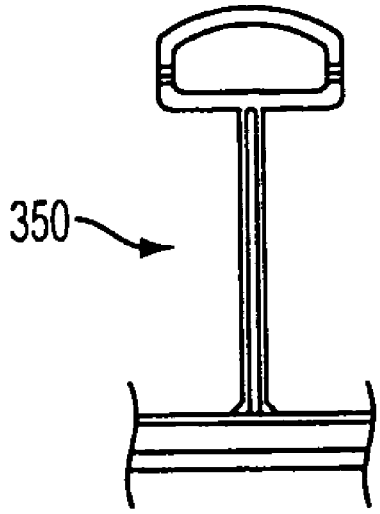
FIG. 3*a* illustrates an insert that is used on a hanger.

FIG. 3*a* illustrates one embodiment of the present invention of an insert comprising part of the beam construction of a hanger beam. Therein, insert 350 may replace a hook and is generally a part of a molded hanger beam with pinch grips or clips. Insert 350 may be attached to the hook of another hanger such as a garment hanger with extended arms and without pinch grips. Insert 350 may grip pants such that it can be attached to the hook of another hanger for example by inserting the hook of the other hanger through the opening of the insert with extended arms holding a jacket. FIG. 3*a* may use the described "S"-shaped design below in its beam construction.

Figure 3B:
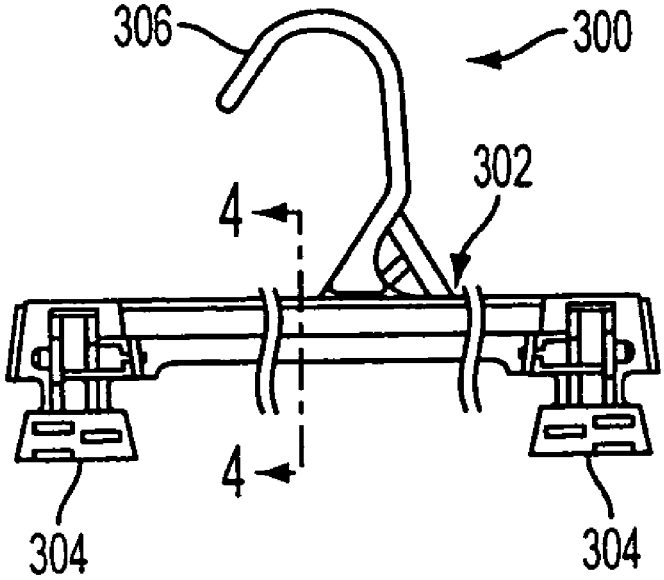
FIG. 3*b* illustrates a profile view of a 12- or 14-inch pinch grip garment hanger.
Figure 3C:
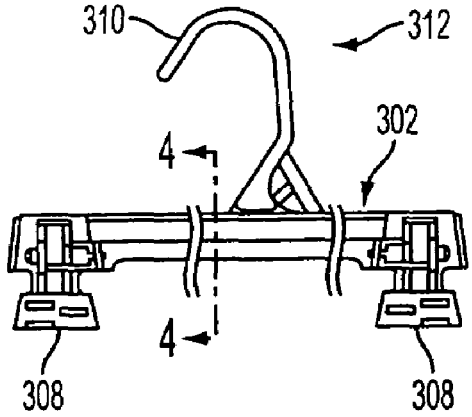
FIG. 3*c* illustrates a profile view of an 8- or 10-inch pinch grip garment hanger.

FIGS. 3*b* and 3*c* illustrate pinch grip hanger and may be styles 6008, 6010, 6012, and 6014 assigned to Randy Hangers, LLC, which generally comprise a one-piece hanger with a molded body and molded hook member. FIG. 3*b* illustrates a profile view of a larger pinch grip garment hanger 300; for example, a 12 to 14 inch pinch grip garment hanger. Hanger 300 of FIG. 3*b* comprises hanger beam 302, pinch grips or clips 304, and hook 306.

FIG. 3*c* illustrates a profile view of a smaller pinch grip garment hanger 312, for example, an 8- or 10-inch pinch grip garment hanger. Hanger 312 of FIG. 3*c* comprises a hanger beam 320, pinch grips or clips 308, and hook 310.

Figure 4:
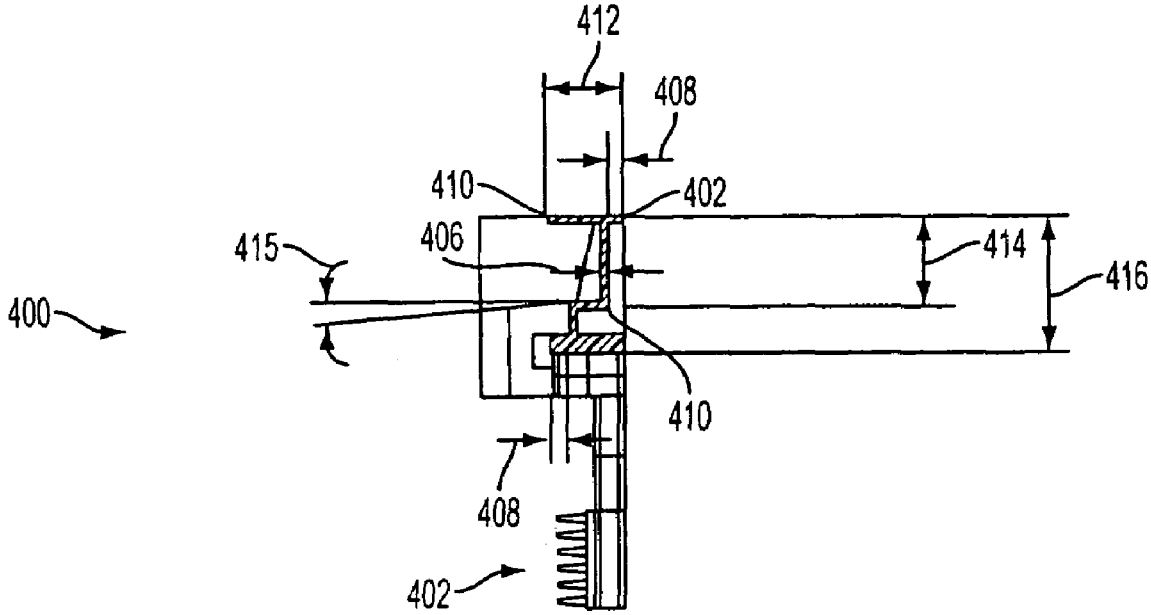
FIG. 4 illustrates the cross section B—B of FIGS. 3*b* and 3*c* showing an alternative "S"-shaped cross beam.

FIG. 4 is an end view taken through the cross section line B—B of FIGS. 3*b* and 3*c*. Shown is cross-section 400 of hanger beams 300 and 312 with "S"-shaped cross section 402 and a side profile of end clip 404. "S"-shaped cross section may have any dimensions, but is provided with preferred dimensions for thickness 406, extensions 408, edge radius 410, overall width 412, height of the bend or curve 414, and overall height 416. Preferably, shaped cross section 402 has thickness 406 between 0.035 and 0.045 inches, extensions 408 preferably 0.080 inches from the "S"-curve, and an edge radius 410 of 0.030. The bend or curve in the "S" is preferably formed at a height 414 of 0.490 inches with a 2-degree inclination or slope. However, in this alternative design, the overall width 412 of "S" shape 402 is preferably 0.312 inches and overall height 416 is preferably 0.750 inches.

As noted above, "S"-shaped cross section 400 is designed to impart strength and stability to the longitudinal axis of the hanger, reduce warping relative to the current, prior art "I"-beam cross-sectional designs, and enable a reduction in hanger material without sacrificing overall hanger strength.

Figure 5:
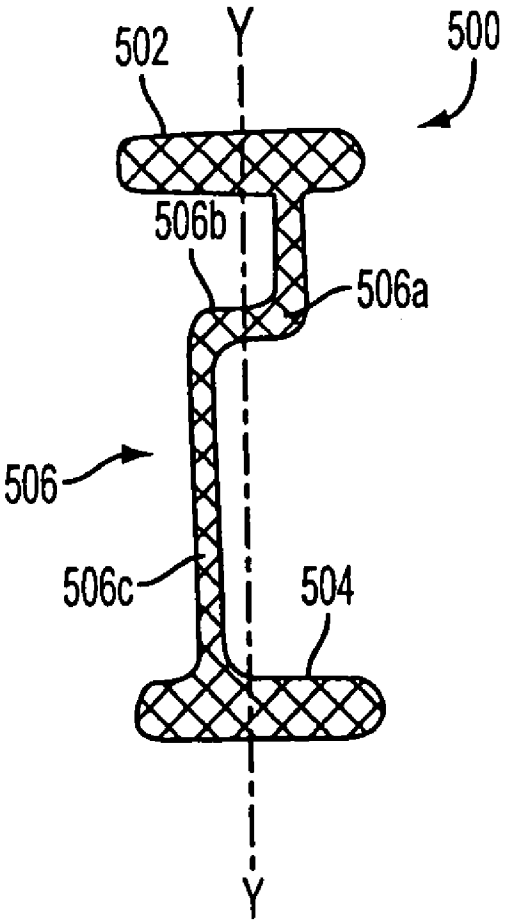
FIG. 5 illustrates an "S" shape for a cross beam design.

Illustrated in FIG. 5 is an "S"-shape 500 used for the hanger beam construction. Therein, the S shape 500 may comprise top and bottom flanges 502 and 504, respectively, that are parallel or substantially parallel to each other. S shape 500 includes a web 506 that is disposed between flanges 502 and 504 and comprises a plurality of portions 506*a*, 506*b*, 506*c*. A first portion 506*a* is joined perpendicularly, or substantially perpendicularly, to one side of a "vertical" plane Y—Y passing through the center of gravity of a hanger, such as hanger 102, 202 or 302, to the top flange 502. A second portion 506*c* is joined perpendicularly, or substantially perpendicularly, to the other side of the "vertical" plane Y—Y to the bottom flange 504. A medial portion 506*b* is disposed to join the first and second segments 506*a*, 506*c*.

As shown in FIGS. 2, 4, and 5, the medial portion 506*b* is inclined at an angle to a horizontal plane and is joined by unequal half-curves to the first and second portions 506*a*, 506*b*. The half-curves are so disposed where the transition of the curves occurs at an angle to the horizontal.

Advantageously, the design of S shape 500 prevents warping and offers superior torsional resistance than similar I beam construction.

Although the "S"-shaped cross sections shown in FIGS. 2, 4, and 5 illustrate preferred cross-sectional embodiments, other cross sectional shapes may also be used. For example, an "S"-shape with equal half-curves may be used for the beam construction (not shown). Furthermore, an "S"-shape with equal half-curves with or without an angular inclination or declination (not shown) may be also used. Additionally, as shown in FIG. 6, other cross-sectional shapes may be used.

Figure 6:
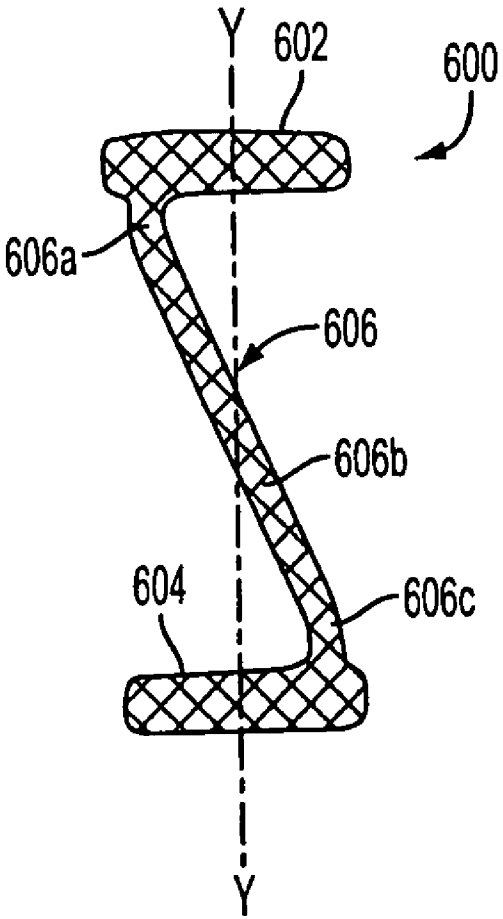
FIG. 6 illustrates an alternative "Z" shape for a cross beam design.

FIG. 6 illustrates an alternative "Z"-shape 600 for the beam construction. Therein, the Z shape 600 may comprise top and bottom flanges 602 and 604, respectively, that are parallel or substantially parallel to each other. Z shape 600 includes a web 606 that is disposed between flanges 602 and 604 and comprises a plurality of portions 606*a*, 606*b*, 606*c*. A first portion 606*a* is joined perpendicularly, or substantially perpendicularly, to one side of a "vertical" plane Y—Y passing through the center of gravity of a hanger, such as hanger 102, 202 or 302, to the top flange 602. A second portion 606*c* is joined perpendicularly, or substantially perpendicularly, to the other side of the "vertical" plane Y—Y to the bottom flange 604. A medial portion 606*b* is disposed to join the first and second portion 606*a*, 606*c*.

Advantageously, the design of Z shape 600 prevents warping and offers superior torsional resistance than similar I beam construction.

Other shapes, such as "W", "N" and other "letter" shapes (not shown) may also be used.

CONCLUSION

A system and method has been shown in the above embodiments for the effective implementation of a hanger beam construction. While various preferred embodiments have been shown and described, it will be understood that there is no intent to limit the invention by such disclosure, but rather, it is intended to cover all modifications and alternate constructions falling within the spirit and scope of the invention, as defined in the appended claims. For example, the present invention should not be limited by size, dimensions, materials, or specific manufacturing techniques.

What is claimed is:

1. A garment hanger comprising:

a hook member for suspending the garment hanger;

a molded body member disposed transversely to the hook member and having a cross-section for reducing warping of the body member comprising a top and bottom flange arranged substantially parallel to one another;

a first web extending from the top flange;

a second web extending from the bottom flange; and a medial web connecting the first and second webs at an angle thereto; and a first pinch grip and a second pinch grip, the plural pinch grips being disposed at opposite ends of the molded body member to grasp a garment.

2. The garment hanger of claim 1, wherein the first web portion is disposed substantially perpendicularly to the top flange to one side of the longitudinal axis passing through the center of gravity of the cross-section; and the second web portion is disposed substantially perpendicularly to the bottom flange to the other side of the longitudinal axis passing through the center of the gravity of the cross-section.

3. The garment hanger of claim 1, wherein the cross-section of the molded body member is an S-shape.

4. The garment hanger of claim 1, wherein the cross-section of the molded body member is a Z shape.

5. The garment hanger of claim 2, wherein the medial web portion is joined to the first and second web portion using half-curves.

6. The garment hanger of claim 2, wherein the medial web portion is not parallel to one of the top and bottom flanges.

7. A garment hanger comprising:

a molded body comprising a hook portion for suspending the hanger and transversely mounted lower body portion having a cross-section for reducing warping of the lower body member comprising a top and bottom flange arranged substantially parallel to one another;

a first web extending from the top flange;

a second web extending from the bottom flange; and a medial web connecting the first and second webs at an angle thereto; and a first pinch grip and a second pinch grip, the plural pinch grips being disposed at opposite ends of the lower body member to grasp a garment.

8. The garment hanger of claim 7, wherein the first web portion is disposed substantially perpendicularly to the top flange to one side of the longitudinal axis passing through the center of gravity of the cross-section; and the second web portion is disposed substantially perpendicularly to the bottom flange to the other side of the longitudinal axis passing through the center of the gravity of the cross-section.

9. The garment hanger of claim 7, wherein the cross-section of the lower body member is an S-shape.

10. The garment hanger of claim 7, wherein the cross-section of the lower body member is a Z shape.

11. The garment hanger of claim 8, wherein the medial web portion is joined to the first and second web portion using half-curves.

12. A body member of a garment hanger, the body member comprising:

a cross-section for reducing warping of the body member, comprising a top and bottom flange arranged substantially parallel to one another;

a first web extending from the top flange;

a second web extending from the bottom flange; and a medial web connecting the first and second webs at an angle thereto.

13. The body member of claim 12, wherein the first web portion is disposed substantially perpendicularly to the top flange to one side of the longitudinal axis passing through the center of gravity of the cross-section; and the second web portion is disposed substantially perpendicularly to the bottom flange to the other side of the longitudinal axis passing through the center of the gravity of the cross-section.

14. The body member of claim 12, wherein the cross-section of the body member is an S-shape.

15. The body member of claim 12, wherein the cross-section of the body member is a Z shape.

16. The body member of claim 13, wherein the medial web portion is joined to the first and second web portion using half-curves.

* * * * *